US009561946B2

(12) United States Patent
Schulz

(10) Patent No.: US 9,561,946 B2
(45) Date of Patent: Feb. 7, 2017

(54) FILLING OF COOLED PRODUCTS

(71) Applicant: Krones AG, Neutraubling (DE)

(72) Inventor: Danilo Schulz, Rain (DE)

(73) Assignee: Krones AG, Neutraubling (DE)

( * ) Notice: Subject to any disclaimer, the term of this patent is extended or adjusted under 35 U.S.C. 154(b) by 448 days.

(21) Appl. No.: 13/869,476

(22) Filed: Apr. 24, 2013

(65) Prior Publication Data

US 2013/0276936 A1 Oct. 24, 2013

(30) Foreign Application Priority Data

Apr. 24, 2012 (DE) ..... 10 2012 206 716

(51) Int. Cl.
*B67C 3/22* (2006.01)
*B67C 3/02* (2006.01)

(52) U.S. Cl.
CPC .. *B67C 3/22* (2013.01); *B67C 3/02* (2013.01)

(58) Field of Classification Search
CPC ..... B67C 3/02; B67C 3/10; B67C 3/14; B67C 2003/226; A23L 3/02; B67D 3/0009; B67D 3/0022
USPC ..... 141/82; 426/325; 222/146.1
See application file for complete search history.

(56) References Cited

U.S. PATENT DOCUMENTS 4,356,681 A * 11/1982 Barnes ..... 53/440
4,507,931 A 4/1985 Barrow et al.
4,649,809 A * 3/1987 Kanezashi ..... 99/290
5,832,697 A * 11/1998 Rogers ..... 53/440
2012/0312419 A1* 12/2012 Wagner et al. ..... 141/11

FOREIGN PATENT DOCUMENTS

| | | |
|---|---|---|
| DE | 102007003919 | 7/2008 |
| DE | 102007003976 | 7/2008 |
| EP | 1357082 | 10/2003 |
| FR | 2520984 | 8/1983 |
| JP | 2002128193 A | 1/2010 |
| JP | 2011255952 | 12/2011 |
| WO | 2009001208 | 12/2008 |

OTHER PUBLICATIONS

DE102012206716.7 German Search Report dated Feb. 18, 2013 (5 pages).
European Search Report for Application No. 13161234.3 dated Aug. 21, 2013 (7 pages).

* cited by examiner

*Primary Examiner* — Timothy L Maust
(74) *Attorney, Agent, or Firm* — Michael Best & Friedrich LLP

(57) ABSTRACT

A method for filling a product. The method including the steps of cooling the product to be filled before or after the introduction of the gas or gas mixture, filling the product to be filled into a filling container, and heating the filled filling container after filling the product to be filled, wherein the cooling and the heating is performed at least partially by means of one heat pump.

17 Claims, 1 Drawing Sheet

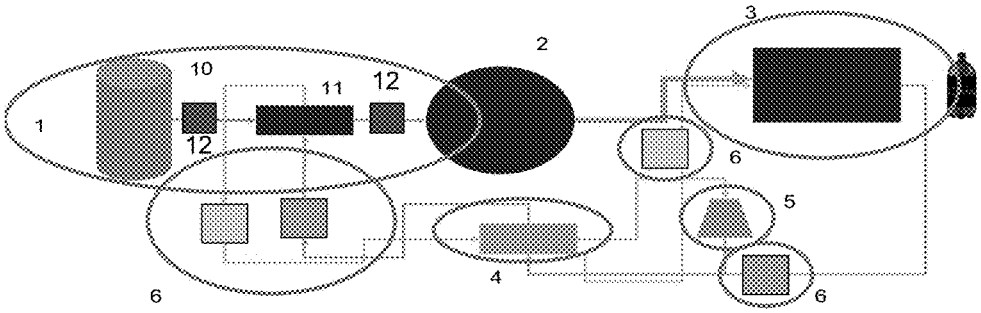
1
10
12
11
12
2
3
6
5
4
6
6

FILLING OF COOLED PRODUCTS

BACKGROUND

The present invention relates to the filling of products, for instance products containing a gas or gas mixture, and in particular to the filling of beverages containing $CO_2$ into dimensionally stable containers at relatively low temperatures. The products or (basic) components of same are to be cooled prior to the filling.

Certain products are cooled prior to filling them into a container. If juices are subjected to a thermal treatment cooling may be required prior to their filling. Products containing a gas or gas mixture, such as products containing $CO_2$, can be filled into filling containers faster if the filling temperature is relatively low, as compared to a relatively high filling temperature. Thus, a higher flow rate at the filler can be achieved. In order to obtain relatively low temperatures of the $CO_2$-containing product to be filled in it is necessary to cool the product upstream of the filler. The required energy is generated in refrigerating plants. According to the state of the art the heat extracted from the product is dissipated to the environment.

However, the filling of relatively cold products/beverages, for instance into cans, PET bottles or glass bottles, may result in condensed water on account of the temperature gradient between the product temperature and dew point temperature. This condensed water may cause problems when the filled containers are packed. For instance, the condensed water may soak the packaging carton, or lead to contaminations when the containers are wrapped into films. Especially in countries where the product temperature is lower than the dew point temperature, and with a high air humidity, heating devices are, therefore, employed to heat the filled containers so as to avoid condensation. Such heating devices can be heated, for instance, with steam.

Thus, the filling process according to the state of the art requires a high energy demand for cooling the product to be filled, on the one hand, and for heating the filled filling containers, on the other hand. The present invention is based on the object to reduce this high energy demand.

SUMMARY

The aforementioned object is achieved by the method for filling a product. This method comprises the steps of cooling the product to be filled (e.g. before or after the mixing); filling the product to be filled into a filling container; and heating the filled filling container after filling the product to be filled; wherein the cooling and the heating is performed at least partially by means of one (one and the same) heat pump.

The product to be filled mentioned in this context and below may also refer to basic components of a product to be ultimately filled (e.g. syrup, water, etc.). In particular, the method may be used for filling a product containing a gas or gas mixture (e.g. a product containing $CO_2$) and, in this case, comprises the steps of: cooling the product to be filled before or after the introduction of the gas or gas mixture; filling the product to be filled and containing a gas or gas mixture into a filling container; and heating the filled filling container after the filling of the product to be filled and containing a gas or gas mixture; wherein the cooling and the heating is accomplished at least partially by means of one (one and the same) heat pump. In particular, the cooling may be performed before or after the introduction of the gas or gas mixture.

The filling may be performed continuously or in the batch mode. The product to be filled may be a beverage containing $CO_2$. The filling container may be a container suited for the filling, e.g. a glass bottle, a plastic bottle, a beverage carton or a beverage can. It is also possible, however, to provide several heat pumps, at least partially cascading and/or at least partially operated in parallel, for cooling the product to be filled and containing $CO_2$ and heating the filled filling container after the filling.

By means of the heat pump heat is extracted from the product to be filled, the product is cooled, and the heat pump utilizes the extracted heat in a heating device for heating the filled filling container. Thus, the heat pump replaces the refrigerating plant used in the state of the art, which dissipates the heat extracted from the containers to be filled to the environment without making use of it. In the heat pump, heat may be extracted in a Carnot cycle from the product to be filled by a suitable heating means, and the extracted heat may be supplied to the filled containers by another suitable heating means. During a continuous production substantially 100% of the heat extracted during the cooling of the containers to be filled may be supplied to the heating device. This allows a significant reduction of the energy demand, as compared to the state of the art.

Depending on the present operating conditions it may be necessary on account of losses (heat transport, heat conduction, heat convection) and/or entrainment to add heat during the step of heating the filled containers. Thus, according to a further development, the method comprises the step of additionally heating the filled containers (in addition to the heat pump) by means of an additional heating device, in particular by means of a heat source (e.g. steam, hot water, solar energy). However, the additional energy demand to be provided for the additional heating device will only be a fraction of the energy contribution to be made by a heating device according to the state of the art, which is operated separately from a cooling device for cooling the product to be filled.

Depending on the construction of the heat pump an excess heat produced during the cooling of the product to be filled may have a negative influence on the function of the heat pump. Therefore, it may be provided to use a portion of the heat produced during the cooling of the product to be filled for other processes, or dissipate it by a cooling device.

In addition, one or more buffer storages may be provided for temporarily storing a cooling medium for cooling the product to be filled and/or a heating medium for heating the filled container in a buffer storage.

Also, the aforementioned object is achieved by an apparatus for filling a product into a filling container, comprising: a filler adapted to fill the product into the filling container (e.g. a glass bottle, a plastic bottle, a beverage carton or a beverage can); and at least one heat pump adapted to cool the product to be filled upstream of the filler and heat the filled filling container downstream of the filler. The product may be a product containing a gas or gas mixture (e.g. a product containing $CO_2$).

Also, several heat pumps, at least partially cascading and/or at least partially operated in parallel, may be provided in the apparatus for cooling the product to be filled and heating the filled filling container after the filling.

The filler may be adapted to fill a beverage containing a gas or gas mixture, e.g. a beverage containing $CO_2$, into a container suited for the filling, e.g. a glass bottle, a plastic bottle, a beverage carton or a beverage can. The apparatus may further comprise a buffer storage for temporarily storing a cooling medium for cooling the product to be filled and/or a buffer storage for temporarily storing a heating medium for heating the filled container.

According to a further development the apparatus further comprises an additional heating device adapted to heat the filled filling container additionally, in particular by means of a steam generator, heat source (e.g. steam, hot water, solar energy).

According to another further development the apparatus comprises a cooling device adapted to dissipate a portion of the heat absorbed by the heat pump during the cooling of the product to be filled.

In all of the above-described examples of the method according to the invention and apparatus according to the invention the heat pump may be operated electrically or by an oil or gas engine.

Embodiments of the method according to the invention will be described below with reference to the drawings. The embodiments described are, in all respects, to be regarded as being merely illustrative and not limiting, and various combinations of the recited features are included in the invention.

BRIEF DESCRIPTION OF THE DRAWING

FIG. 1 illustrates an example of a structure according to the invention of an apparatus for the filling of products containing a gas or gas mixture into filling containers.

DETAILED DESCRIPTION

As is shown in FIG. 1, heat is extracted from a product flow of a product containing a gas or gas mixture, e.g. lemonade containing $CO_2$, which is supplied continuously or in a batch mode, in a process unit 1 upstream of a filler 2. The process unit comprises a product feeder (e.g. buffer tank) 10 and a mixer 11, in which $CO_2$ (or another gas mixture) is, inter alia, added to the product supplied from the product tank 10, as well as other process step units/machines 12 necessary for the product. The order of the process step units 12 may vary product-specifically. The product to be filled in the filler 2 is cooled by one or more heat transfer means (not shown). After the product to be filled was filled by filler 2 into filling containers, e.g. plastic bottles, the filled containers are conveyed to a heating device 3. The heating device 3 may comprise several chambers (including heat transfer means) with different temperatures (temperature zones), which are fed from one or more heat source(s) by one or more heat transfer means. In particular, it may also comprise a chamber in which heating steam or other heat sources (hot water, solar energy) is/are used for heating the filled containers. In general, the different chambers may be operated with different/several heat sources.

According to the invention, the cooling of the product to be filled and the heating of the filled containers is performed by means of a heat pump 4, in which heat produced during the cooling of the product to be filled is used to heat the filled containers, e.g. in one of the aforementioned chambers of the heating device 3. The heat pump may be operated continuously or in a batch mode.

If too much heat is produced by the cooling of the product to be filled, so that a most efficient utilization of the heat pump is impaired, a portion of the heat may be used for other processes or dissipated by a corresponding cooling device 5.

Also, a plurality of at least partially cascading and/or partially parallel heat pumps may be provided. Individual stages of cascading heat pumps may be operated by a heat pump alone or, additionally, by other heating/cooling devices.

As is shown in FIG. 1, individual subunits of the process unit 1 may be connected to each other upstream of the filler 2 by buffer storages 6. They may also be operated in a bypass mode. Buffer storages 6 may also be provided on the side downstream of the filler 2. Desired temperature profiles may be obtained selectively by a thermal layering in the respective buffer storages 6 and/or a mixed operation of the heating/cooling media which are supplied to and withdrawn from the heat transfer means.

What is claimed is:

1. A method for filling a container with a product, the method comprising the steps of:

cooling the product;

filling the container with the product; and heating the filled container;

wherein the cooling and the heating is performed by means of a single heat pump; and wherein a portion of heat produced during the cooling of the product is used to heat the filled container and an excessive portion of the heat produced during the cooling of the product is dissipated by a cooling device connected to the heat pump.

2. The method of claim 1, wherein the product contains at least one selected from the group consisting of a gas and a gas mixture.

3. The method of claim 1, wherein the product to be filled is a beverage, and/or the container is at least one selected from the group consisting of, a glass bottle, a plastic bottle, a beverage carton and a beverage can.

4. The method of claim 1, wherein the heating is additionally accomplished by means of an additional heating device.

5. The method of claim 1, wherein a second portion of heat absorbed by the heat pump during the cooling of the product is used for other process steps.

6. The method of claim 1, wherein further a cooling medium for cooling the product and/or a heating medium for heating the filled container is/are temporarily stored in a buffer storage.

7. The method of claim 1, wherein the cooling and the heating is accomplished by means of a plurality of heat pumps at least partially cascading and/or at least partially operated in parallel.

8. The method of claim 1, wherein the heating is additionally accomplished by means of at least one selected from the group consisting of a steam generator, hot water, and solar energy.

9. An apparatus for filling a container with a product, the apparatus comprising:

a filler adapted to fill the container with the product;

a single heat pump adapted to cool the product upstream of the filler and heat the filled container downstream of the filler and to use heat produced during a cooling of the product to heat the filled container; and a cooling device adapted to dissipate a portion of the heat absorbed by the heat pump during cooling.

10. The apparatus of claim 9, wherein the product contains at least one selected from the group consisting of a gas and a gas mixture.

11. The apparatus of claim 10, wherein the filler is adapted to fill a beverage containing at least one selected from the group consisting of a gas and a gas mixture into a container suited for the filling, wherein the container is at least one selected from the group consisting of a glass bottle, a plastic bottle, a beverage carton and a beverage can.

12. The apparatus of claim 9, further comprising a buffer storage for temporarily storing a cooling medium for cooling the product and/or a buffer storage for temporarily storing a heating medium for heating the filled container.

13. The apparatus of claim 9, further comprising an additional heating device adapted to heat the filled container additionally.

14. The apparatus of claim 9, wherein the cooling device is further adapted to supply the portion of heat absorbed by the heat pump during cooling to other process steps.

15. The apparatus of claim 9, wherein the heat pump is a heat pump that is operated electrically, by an oil engine or a gas engine.

16. The apparatus of claim 9, comprising a plurality of heat pumps at least partially cascading and/or at least partially operated in parallel.

17. The apparatus of claim 9, further comprising at least one selected from the group consisting of a steam generator configured to heat the filled container, hot water configured to heat the filled container, and solar energy configured to heat the filled container.

* * * * *